US005596976A

United States Patent [19]

Waiser

[11] Patent Number: 5,596,976

[45] Date of Patent: Jan. 28, 1997

[54] TRIGGER DEVICE FOR CROSSBOWS, WITH AUTOMATICALLY ACTIVATED SAFELY MEANS

[76] Inventor: Shimon Waiser, 1227 E. 84 St., Brooklyn, N.Y. 11236

[21] Appl. No.: 596,651

[22] Filed: Feb. 5, 1996

[51] Int. Cl.[6] ..... F41B 5/12

[52] U.S. Cl. ..... 124/25; 124/40

[58] Field of Search ..... 124/25, 35.1, 35.2, 124/40

[56] References Cited

U.S. PATENT DOCUMENTS

| | | | |
|---|---|---|---|
| 4,173,964 | 11/1979 | Curran | 124/40 |
| 4,192,281 | 3/1980 | King | 124/25 |
| 4,716,880 | 1/1988 | Adkins | 124/25 |
| 4,721,092 | 1/1988 | Waiser | 124/40 |
| 4,877,008 | 10/1989 | Troubridge | 124/25 |
| 4,962,747 | 10/1990 | Biller | 124/40 |
| 5,025,771 | 6/1991 | Hanson | 124/25 |
| 5,215,069 | 6/1993 | Liu | 124/25 |

*Primary Examiner*—John A. Ricci

[57] ABSTRACT

A crossbow trigger device having an automatically activated safety includes a trigger, a catch and at least one safety lever or stem cooperating with a projectile pusher, such as a crossbow string, or with a catch. The catch is pivotally mounted in the trigger device and has an upper part extending above the trigger device. When the projectile pusher is being cocked back, it engages and pivots the catch and moves the safety lever or stem to a safe position in which the safety lever or stem prevents the catch from being turned by the projectile pusher if the trigger is unintentionally pulled. The trigger device is also provided with a knob accessible by a user and connected to the safety lever or stem to manually unlock or lock the catch.

20 Claims, 10 Drawing Sheets

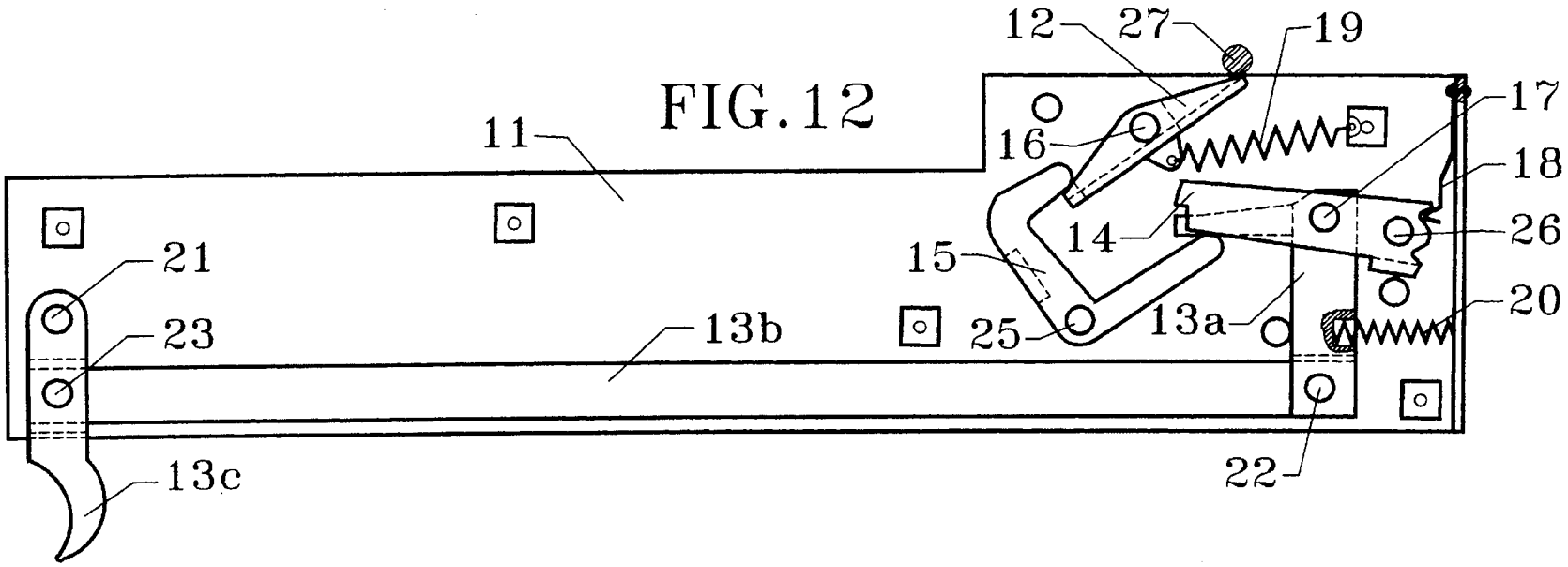
FIG. 12
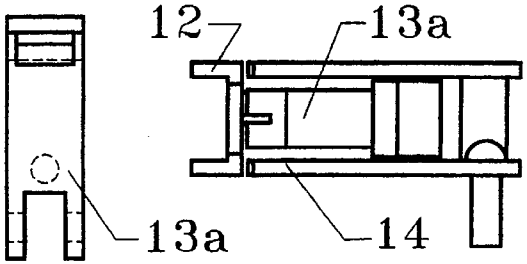
FIG. 11
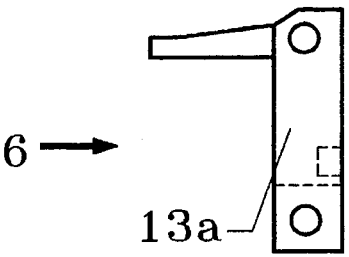
FIG. 10
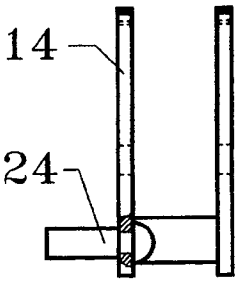
FIG. 9
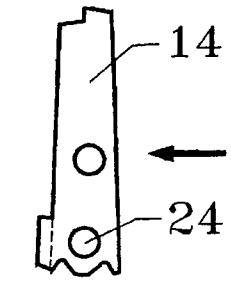
FIG. 8
FIG. 7

111
112
113
114
115
116
117
118
119
120
125
126
127
7

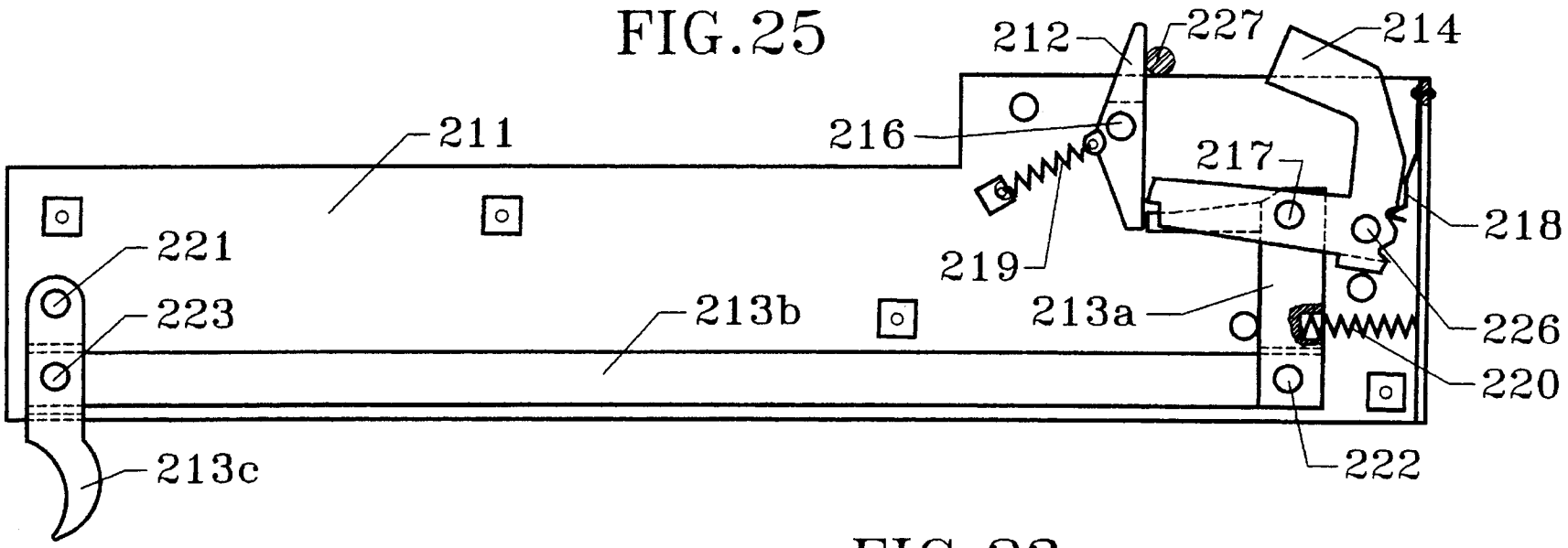
FIG.25
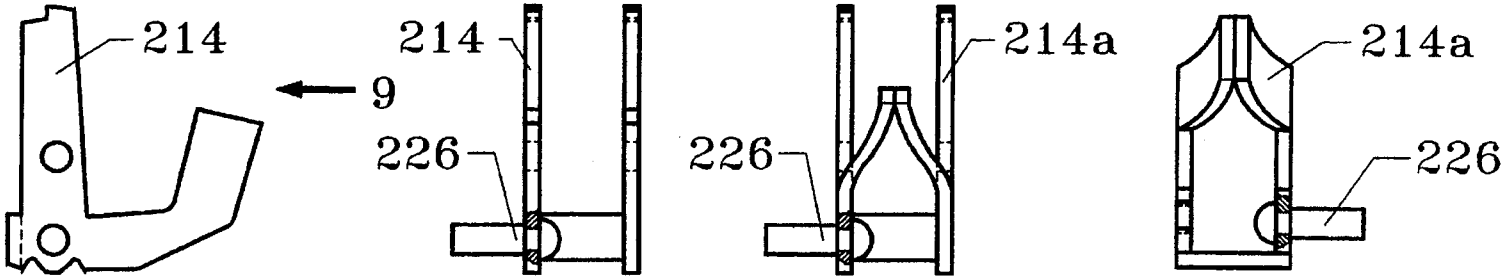
FIG.24
FIG.23
FIG.22
FIG.21

TRIGGER DEVICE FOR CROSSBOWS, WITH AUTOMATICALLY ACTIVATED SAFELY MEANS

BACKGROUND OF THE INVENTION

This invention relates to trigger mechanisms, and in particular to trigger devices for crossbows having automatic safety means.

Trigger devices for crossbows are disclosed for example in U.S. Pat. No. 4,030,473, U.S. Pat. No. 4,192,281, and U.S. Pat. No. 4,721,092. They include safety mechanisms with automatic safety means that lock crossbow triggers, thereby preventing unintentional shooting. However, after several hundred shots, contacting surfaces of the catch and the trigger become worn and torn, and at some time the trigger may not hold the catch when the crossbow is cocked. Thereafter it does not matter if the crossbow safety is in "FIRE" or in "SAFE" position, because the crossbow is not safe at all.

SUMMARY OF THE INVENTION

Accordingly, it is an object of the present invention to provide a crossbow trigger device with automatically activated safety means which avoids the disadvantages of the prior art.

Another object of the invention is to provide a crossbow automatic safety mechanism with a moving part which locks a crossbow catch in safe position.

It is a further object of the present invention to provide a crossbow automatic safety mechanism with a moving part which can lock both a crossbow catch and a crossbow trigger in safe position for maximum reliability.

Other objects and advantages of the present invention will be apparent from the accompanying description when considered in conjunction with the accompanying drawings.

BRIEF DESCRIPTION OF THE DRAWINGS

FIG. 7 is a side view of the safety lever shown in FIG. 1;

FIG. 8 is a rear view of the safety lever looking in the direction of arrow 5 in FIG. 7;

FIG. 9 is a side view of the intermediate trigger part shown in FIG. 1;

FIG. 10 is a front view of the intermediate trigger part looking in the direction of arrow 6 in FIG. 9;

FIG. 11 shows a relative position of the catch, the safety lever and the intermediate trigger part looking in the direction of arrow 1 in FIG. 1;

FIG. 12 is a side view of the trigger device of the first modification similar to FIG. 1 during the projectile pusher movement backwards above the catch;

Figure 18:
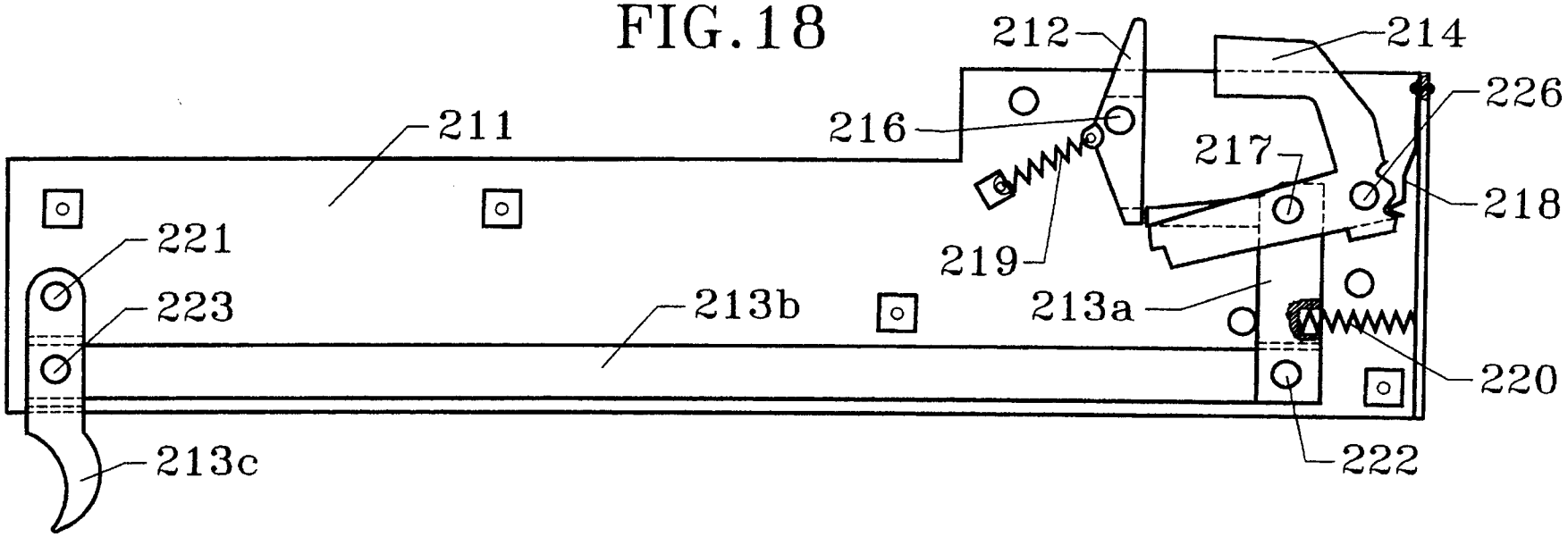
Figure 20:
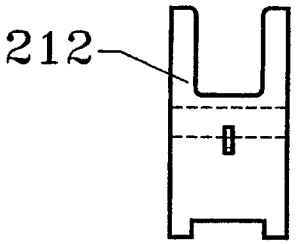
Figure 19:
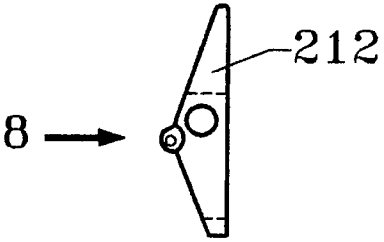
Figure 26:
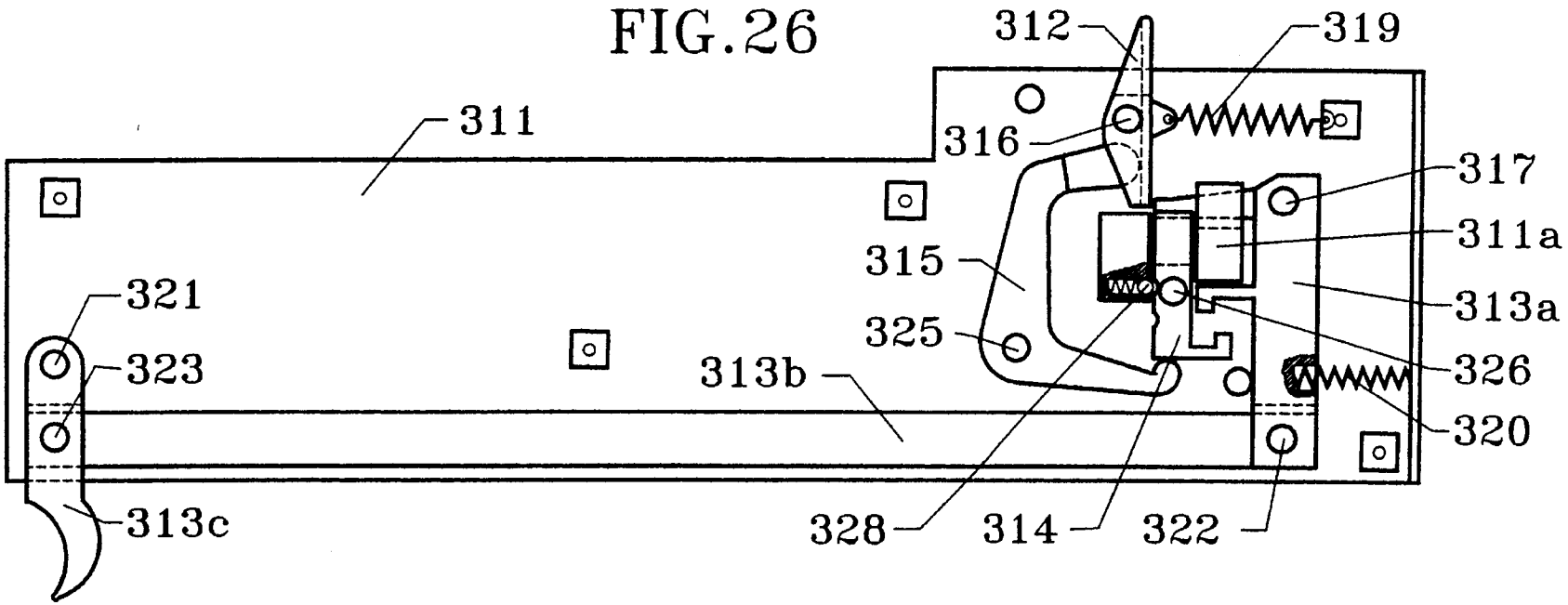
Figure 31:
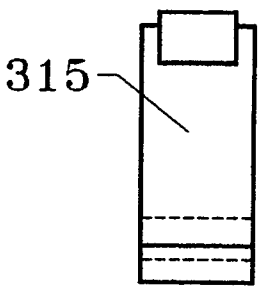
Figure 30:
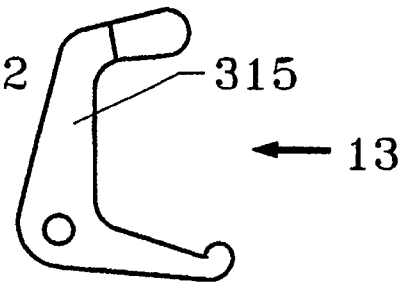
Figure 29:
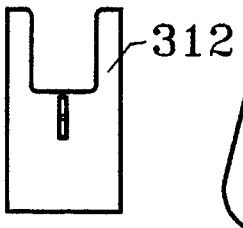
Figure 28:
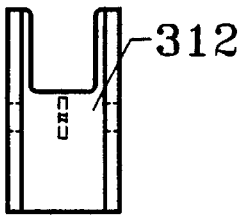
Figure 27:
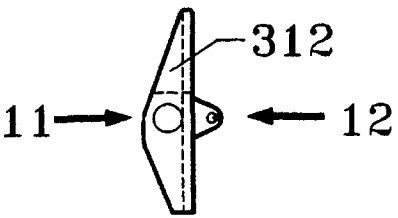
Figure 37:
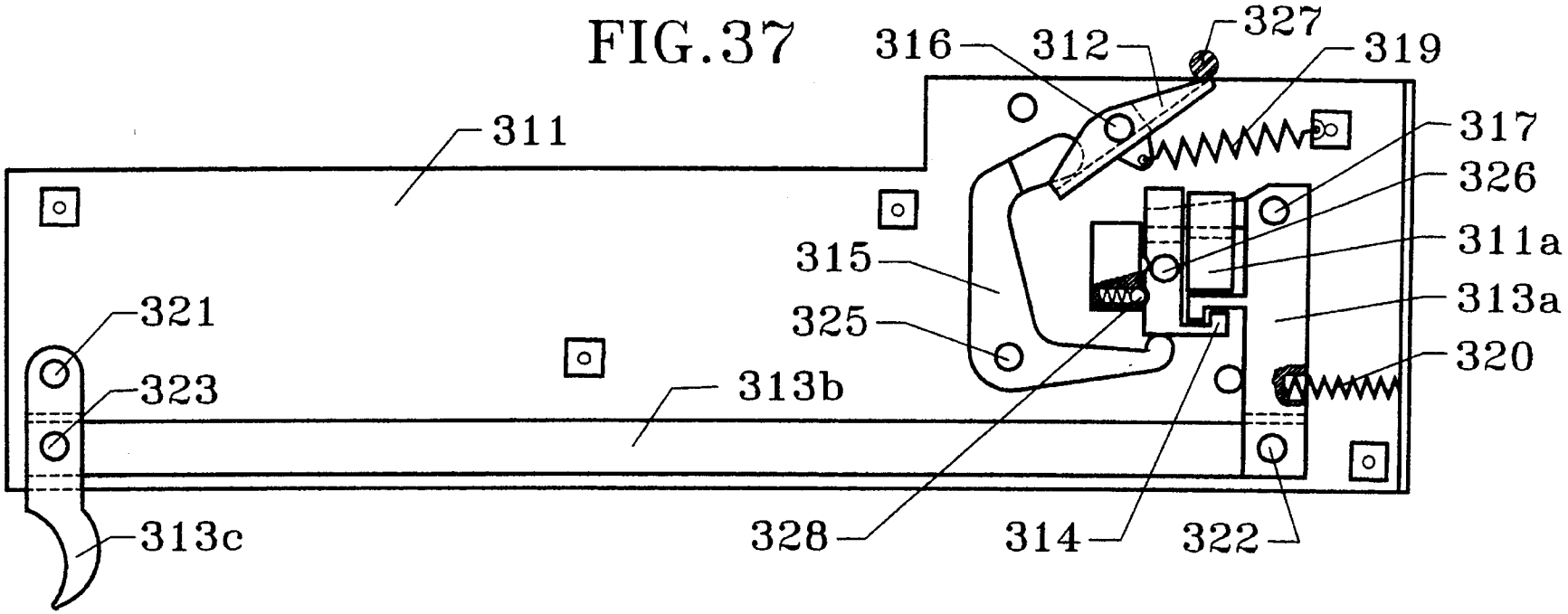
Figure 36:
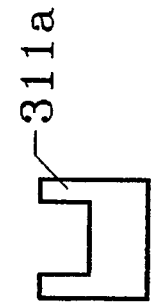
Figure 35:
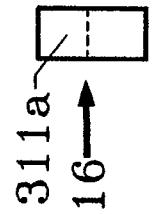
Figure 34:
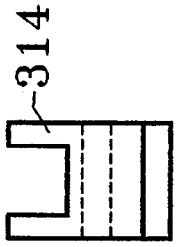
Figure 33:
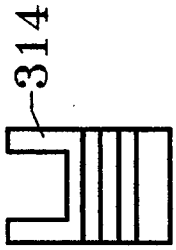
Figure 32:
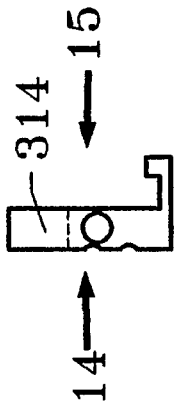
Figures 38, 39, 40:
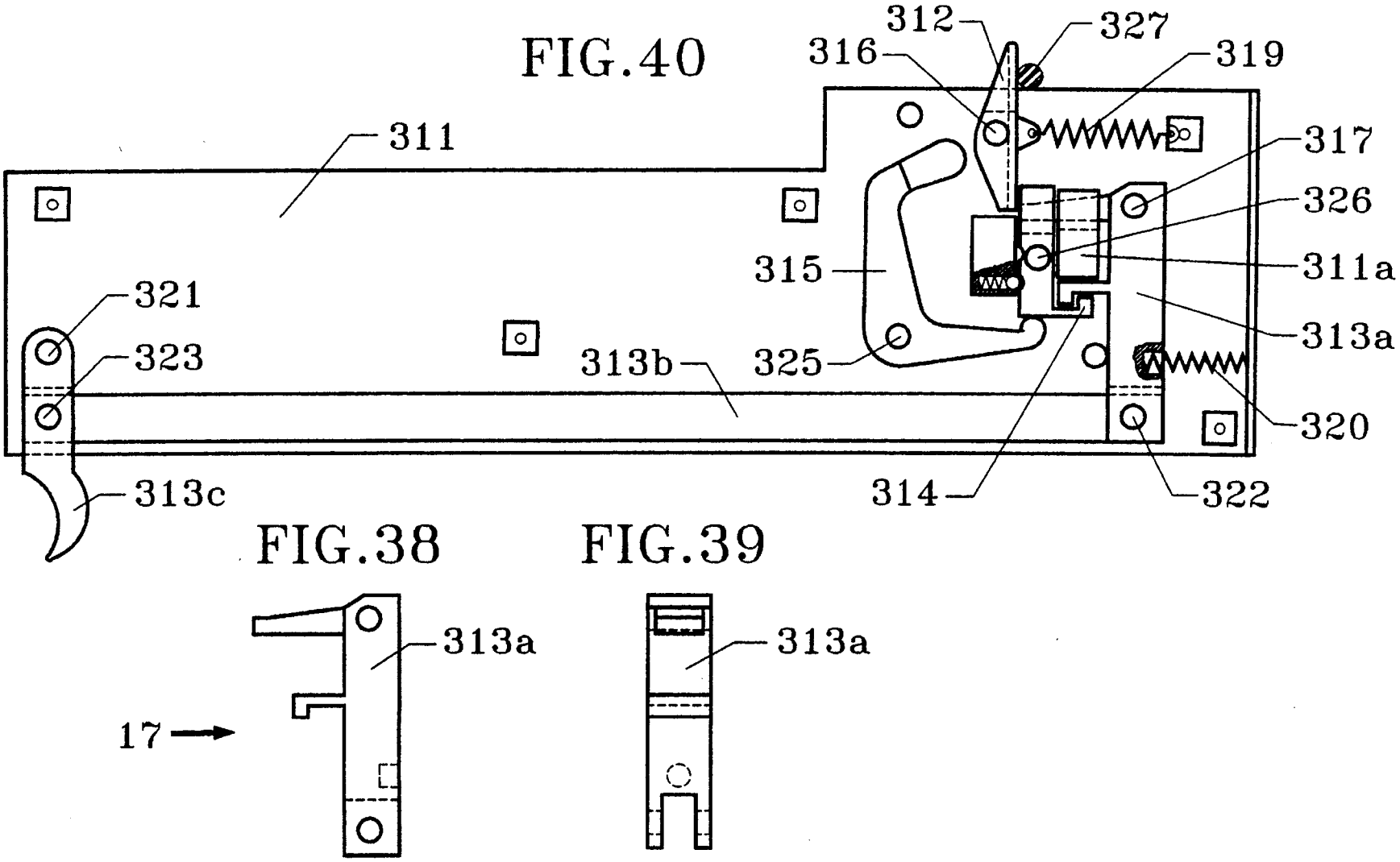

FIG: 18 is a side view of the trigger device of the third modification in a fire (unlocked) position, partly in section, with one side plate removed;

FIG. 19 is a side view of the catch shown in FIG. 18;

FIG. 20 is a front view of the catch looking in the direction of arrow 8 in FIG. 19;

FIG. 21 is a side view of the safety lever shown in FIG. 18;

FIG. 22 is a rear view of the safety lever looking in the direction of arrow 9 in FIG. 21;

FIG. 23 is a rear view of the safety lever similar to FIG. 22 which has a slightly changed shape;

FIG. 24 is a view of the safety lever looking in the direction of arrow 10 in FIG. 23;

FIG. 25 is a side view of the trigger device of the third modification, similar to FIG. 18, in a safe position;

FIG. 26 is a side view of the trigger device of the fourth modification in a fire (unlocked) position, partly in section, with one side plate removed;

FIG. 27 is a side view of the catch shown in FIG. 28;

FIG. 28 is a front view of the catch looking in the direction of arrow 11 in FIG. 27;

FIG. 29 is a rear view of the catch looking in the direction of arrow 12 in FIG. 27;

FIG. 30 is a side view of the intermediate member shown in FIG. 26;

FIG. 31 is a rear view of the intermediate member looking in the direction of arrow 13 in FIG. 30;

FIG. 32 is a side view of the safety stem shown in FIG. 26;

FIG. 33 is a front view of the safety stem looking in the direction of arrow 14 in FIG. 32;

FIG. 34 is a rear view of the safety stem looking in the direction of arrow 15 in FIG. 32;

FIG. 35 is a side view of the safety stem support part attached to the trigger device side plate shown in FIG. 26;

FIG. 36 is a front view of the safety stem support part looking in the direction of arrow 16 in FIG. 35;

FIG. 37 is a side view of the trigger device of the fourth modification, similar to FIG. 26, during the projectile pusher movement backwards above the catch;

FIG. 38 is a side view of the intermediate trigger part shown in FIG. 26;

FIG. 39 is a front view of the intermediate trigger part looking in the direction of arrow 17 in FIG. 38;

FIG. 40 is a side view of the trigger device of the fourth modification, similar to FIG. 26, in a safe position.

Figure 42:
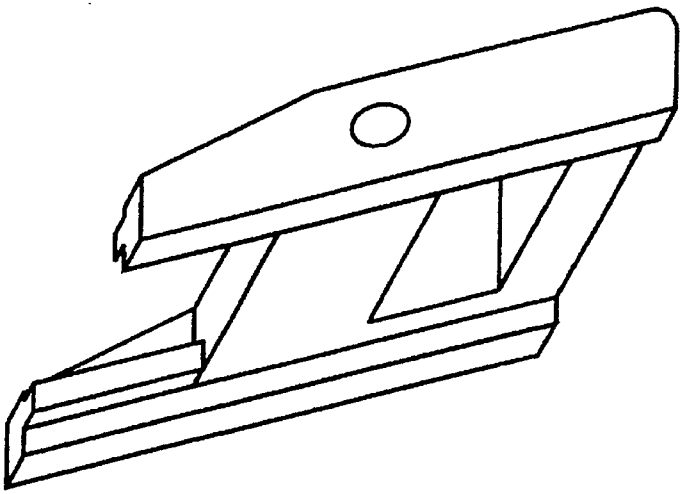
Figure 41:
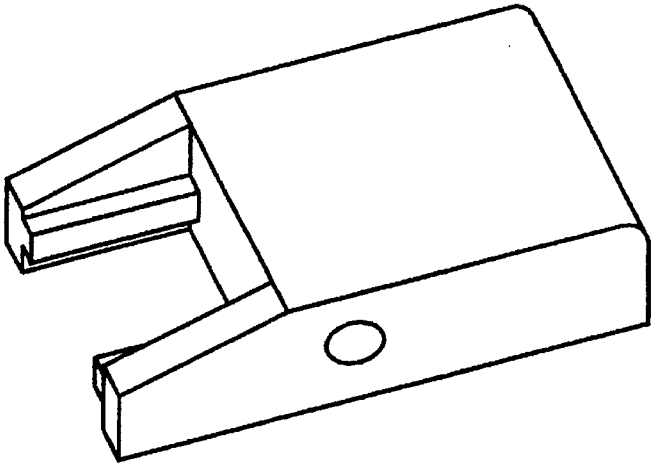

FIG. 41 is an enlarged perspective view of the slide-pusher if it is observed from above;

FIG. 42 is another enlarged perspective view of the slide-pusher if it is observed from below.

DETAILED DESCRIPTION

Referring more in detail to the drawings. FIGS. 1–13 show main features of the trigger device of the first modification.

The trigger device comprises two side plates 11. A catch 12 is pivotally mounted by a pivot pin 16, an intermediate trigger part 13*a* and a safety lever 14 are both pivotally mounted by a pivot pin 17, an intermediate member 15 is pivotally mounted by a pivot pin 25, and a main trigger part 13*c* is pivotally mounted by a pivot pin 21 between the side plates 11. A transferring trigger part 13*b* is pivotally mounted by pivot pins 22 and 23 on the intermediate trigger part 13*a* and the main trigger part 13*c*. The catch 12 is under the action of a spring 19, the entire extended trigger (parts 13*a*, 13*b* and 13*c*) is under the action of a spring 20, which returns said catch 12 and all three trigger parts to their initial positions after they have been moved. The safety lever 14 has two working positions, namely, fire and safe positions, and a spring 18 fixes the safety lever 14 in each of these positions. In the fire position (see FIG. 1) the safety lever 14 is not disposed opposite the catch 12 and the latter can be pivoted counter-clockwise for a shot, when it is not engaged by the intermediate trigger part 13*a*. In the safe position (see FIG. 13) the safety lever 14 is disposed opposite the catch 12 and the latter can not be pivoted, and, therefore, a shot can not be made. A knob 26 projecting outside of the trigger device can move the safety lever 14 from the fire position to the safe position and vice versa, if a shooter manually moves the knob 26 in corresponding directions. The safety lever 14 also can be moved from the fire position (see FIG. I) to the safe position (see FIG. 13) by the projectile pusher, such as a bow string 27, or by an additional projectile slide-pusher see FIGS. 41–42 connected to the bow string 27, which turns the catch 12 clockwise (see FIG. 12), and the catch 12, in turn, pushes and pivots the intermediate member 15 counter-clockwise. During its turning the intermediate member 15 pushes and turns the safety lever 14 clockwise to the safe position.

Figure 1:
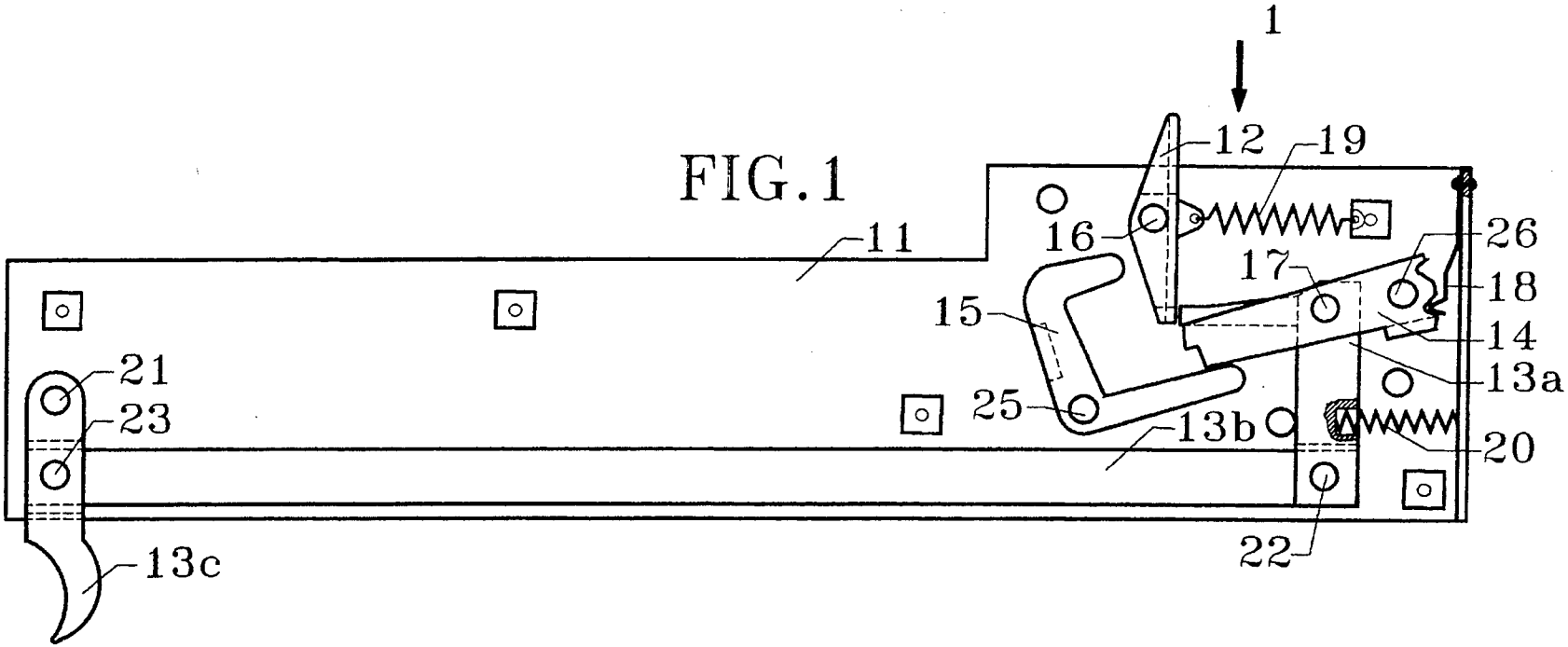
FIG. 1 is a side view of the trigger device of the first modification in a fire (unlocked) position, partly in section, with one side plate removed.
Figures 2, 3, 4, 5, 6:
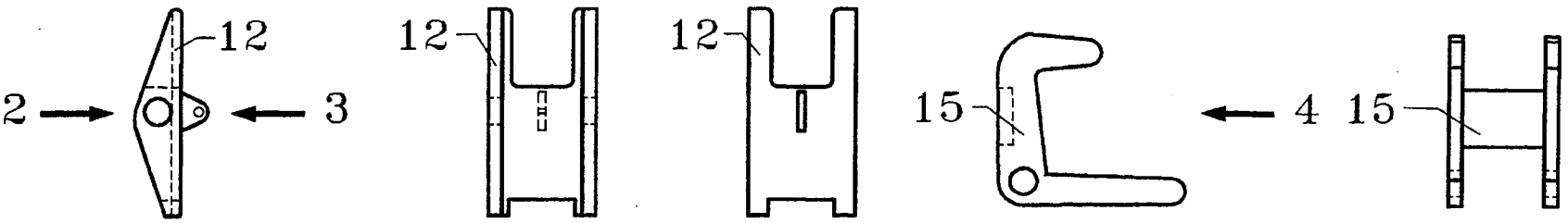
FIG. 2 is a side view of the catch shown in FIG. 1.
FIG. 3 is a front view of the catch looking in the direction of arrow 2 in FIG. 2.
FIG. 4 is a rear view of the catch looking in the direction of arrow 3 in FIG. 2.
FIG. 5 is a side view of the intermediate member shown in FIG. 1.
FIG. 6 is a rear view of the intermediate member looking in the direction of arrow 4 in FIG. 3.
Figure 13:
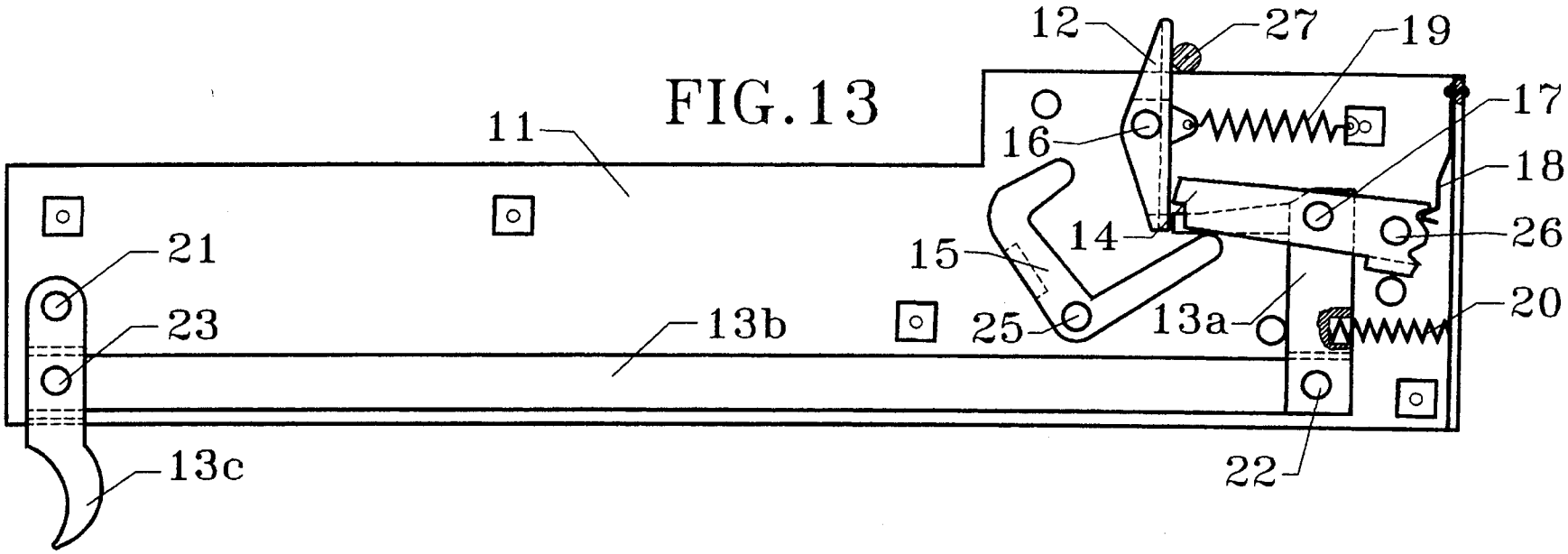
FIG. 13 is a side view of the trigger device of the first modification similar to FIG. 1 in a safe position.
Figures 14, 15, 16, 17:
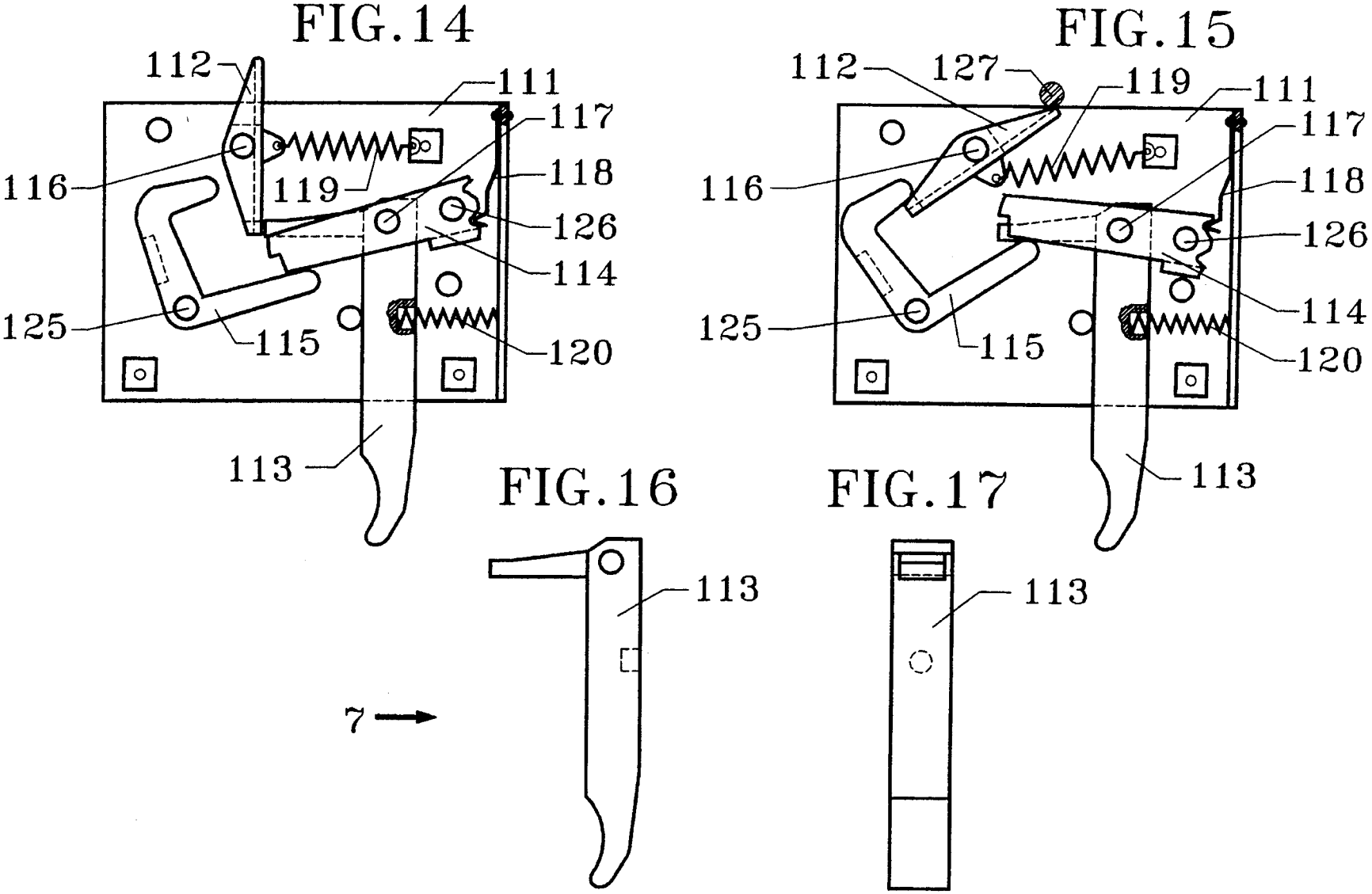
FIG. 14 is a side view of the trigger device of the second modification in a fire (unlocked) position, partly in section, with one side plate removed.
FIG. 15 is a side view of the trigger device of the second modification, similar to FIG. 14, during the projectile pusher movement backwards above the catch.
FIG. 16 is a side view of the trigger shown in FIG. 14.
FIG. 17 is a front view of the trigger looking in the direction of arrow 7 in FIG. 16.

Usually after a shot the safety lever 14 stays in the fire position (see FIG. 1). To cock a crossbow (not shown) a user moves a projectile pusher, which can be the crossbow string 27 or a slide-pusher (not shown), backwards and engages the pusher with the catch 12. During this movement the projectile pusher turns the catch 12 clockwise (see FIG. 12) and the catch 12 pushes and pivots the intermediate part 15 counter-clockwise, which, in turn, pushes and pivots clockwise the safety lever 14 to the safe position. After this the catch 12 can not be turned for a shot even if the user pulls the trigger. To make a shot, the user has to move the safety lever 14, using the knob 26, to the fire position and only after this the user may pull the trigger to fire a shot. If the user pulls the trigger to fire a shot before he or she moved the safety lever 14 to the fire position, the catch, released from the engagement with the intermediate part 13*a*, will not turn for a shot anyway, because it is engaged with the safety lever 14. As was mentioned above, the user can manually move the safety lever 14 from fire to safe position and vice versa using the knob 26.

Referring now to FIGS. 14–17 which show main features of the trigger device of the second modification.

The trigger device of the second modification is similar to the trigger device of the first modification (FIGS. 1–13) with two small differences, namely, the extended trigger (parts 13*a*, 13*b* and 13*c*) of the first modification is replaced by a trigger 113 (a one piece part) of the second modification, and the long side plates 11 of the first modification are replaced by shod side plates 111 of the second modification. All other parts are exactly the same and the interaction of all parts in both modifications is the same. Each part number in the first modification trigger device has the corresponding part number in the second modification trigger device. For example, the catch 12 in trigger device of the first modification has the corresponding catch 112 in the trigger device of the second modification.

Referring now to FIGS. 18–25 which show main features of the trigger device of the third modification.

The trigger device comprises two side plates 211. A catch 212 is pivotally mounted by a pivot pin 216, an intermediate trigger part 213*a* and a safety lever 214 are both pivotally mounted by a pivot pin 217, and a main trigger part 213*c* is pivotally mounted by a pivot pin 221 between the side plates 211. A transferring trigger part 213*b* is pivotally mounted by pivot pins 222 and 223 on the intermediate trigger part 213*a* and the main trigger part 213*c*. The catch 212 is under the action of a spring 219, the entire extended trigger (parts 13*a*, 13*b* and 13*c*) is under the action of a spring 220, which returns said catch 212 and all three trigger parts to their initial positions after they have been moved. The safety lever 214 has two working positions, namely, fire and safe positions, and a spring 218 fixes the safety lever 214 in each of these positions. In the fire position (see FIG. 18), the safety lever 214 is not disposed over against the catch 212 and the latter can be pivoted counter-clockwise for a shot, when it is not engaged by the intermediate trigger part 213*a*. In the safe position (see FIG. 25) the safety lever 214 is disposed over against the catch 212, and the latter can not be pivoted, and, therefore, a shot can not be made. A knob 226 projecting outside of the trigger device can move the safety lever 214 from the fire position to the safe position and vice versa, if a shooter manually moves the knob 226 in the corresponding direction. The safety lever 214 also can be moved from the fire position (see FIG. 18) to the safe position (see FIG. 25) by the projectile pusher, such as a bow string 227, which turns the safety lever 214 clockwise during crossbow cocking. FIG. 22 and FIGS. 23–24 show two slightly different modifications of the safety lever 214 of FIG. 21. The safety lever 214*a* of the second modification has different shape and length of the upper part which projects above the trigger device.

Three slightly different sequences of the trigger parts interaction during the crossbow cocking exist depending on a shape and length of the upper part of the safety lever, as follows:

1. If the safety lever is one shown in FIGS. 21 and 22, i.e. it is the safety lever 214, then to cock a crossbow (not shown) a user moves a projectile pusher 227 backwards and engages the pusher 227 with the catch 212. During this movement the projectile pusher 227 pivots the catch 212 clockwise until the upper part of the catch 212 sinks under the upper surface of the crossbow on which the rear part of an arrow (bolt) rests before shot. At the end of this operation, the projectile pusher 227 also engages the upper part of the safety lever 214, pushing and pivoting the latter clockwise to the safe position. After this the catch 212 cannot be turned for a shot even if the user pulls the trigger.

2. If the safety lever has a shape which is very similar to that shown in FIGS. 21 and 22 with a slightly more elongated forward upper part, then to cock a crossbow the user moves the projectile pusher 227 backwards and engages the pusher 227 with the catch 212. During this movement the projectile pusher 227 turns the catch 212 clockwise. The catch 212, in turn, engages and pivots the safety lever clockwise. At certain point the upper part of the catch sinks under the upper surface of the crossbow, on which a rear part of an arrow rests before shot, and then the projectile pusher 227 engages the upper part of the safety lever proceeding to pivot the safety lever clockwise to the safe position. After this the catch 212 cannot be turned for a shot even if the user pulls the trigger.

3. If the safety lever is the one shown in FIGS. 23 and 24, i.e. it is the safety lever 214*a*, then to cock a crossbow (not shown) a user moves a projectile pusher 227 backwards and engages the pusher 227 with the catch 212. During this movement the projectile pusher 227 turns the catch 212 clockwise. The catch 212 pivots without engaging the safety lever 214*a* because the safety lever 214*a* has a shape permitting its upper part to be located inside of an opening in the upper part of the catch 212. During this movement of the catch 212, the projectile pusher 227 at certain point engages the upper part of the safety lever 214*a* pushing and pivoting the latter clockwise to the safe position. After this the catch 212 cannot be turned for a shot even if the user pulls the trigger.

To make a shot, the user has to move the safety lever 214 (214*a*), using the knob 226, to the fire position and only after this the user may pull the trigger to fire a shot. If the user pulls the trigger to fire a shot before he or she moved the safety lever 214 (214*a*) to the fire position, the catch 212, released from the engagement with the intermediate part 213*a*, will not turn for a shot anyway, because it is engaged with the safety lever 214 (214*a*). As it was mentioned above, the user can manually move the safety lever 214 (214*a*) from fire to safe position and vice versa using the knob 226.

Referring now to FIGS. 26–40 which show main features of the trigger device of the fourth modification.

The trigger device comprises two side plates 311. A catch 312 is pivotally mounted by a pivot pin 316, an intermediate trigger part 313*a* is pivotally mounted by a pivot pin 317, an intermediate member 315 is pivotally mounted by a pivot pin 325, and a main trigger part 313*c* is pivotally mounted by a pivot pin 321 between the side plates 311. A transferring trigger part 313*b* is pivotally mounted by pivot pins 322 and 323 on the intermediate trigger part 313*a* and the main trigger part 313*c*. The catch 312 is under the action of a spring 319, the entire extended trigger (parts 313*a*, 313*b* and 313*c*) is under the action of a spring 320, which returns said catch 312 and all three trigger parts to their initial positions after they have been moved. A safety stem 314 is located above the bottom part of the intermediate member 315. The safety stem 315 has two working positions, namely, fire and safe positions. In the fire position (see FIG. 26) the stem 314 does not engage the catch 312 and the intermediate trigger part 313*a*, and the catch 312 and the part 313*a* can be pivoted for a shot. In the safe position (see FIG. 40), the stem 314 engages the catch 312 and the intermediate trigger part 313*a* and they cannot be pivoted and therefore a shot cannot be made. A knob 326 projecting outside of the trigger device can move the safety lever 314 from the fire position to the safe position and vice versa if a shooter manually moves the knob 326 in corresponding directions. The safety stem 314 also can be moved from the fire position (see FIG. 26) to the safe position (see FIG. 40) under the action of the bow string 327 or the projectile slide-pusher (not shown) connected to the string 327, that turns the catch 312 clockwise (see FIG. 37), and the catch 312, in turn, pushes and pivots the intermediate member 315 counter-clockwise. During its turning, the intermediate member 315 pushes by its bottom part the stem 314 upwards into an engagement with the catch 312 and the intermediate member 313*a*, locking both parts (312 and 313*a*) to prevent a shot. A spring loaded steel ball 328 is arranged to fix the stem 314 in the fire and safe positions. The part 311*a* is an integral part of the side plate 311. The part 311*a* has an opening in which the upper forward looking part of the intermediate part 313*a* is located.

Usually, after a shot the safety stem 314 stays in the fire position (see FIG. 26). To cock a crossbow (not shown) a user moves a projectile pusher 327, which can be the crossbow string 327 or the slide-pusher (see FIGS. 41–42), backwards and engages the pusher with the catch 312. During this movement backwards the projectile pusher turns the catch 312 clockwise (see FIG. 37), and the catch 312 pushes the upper part of the intermediate member 315, and thereby pivots the member 315 counter-clockwise. The intermediate member 315, in turn, pushes by its bottom part the safety stem 314 upwards and the stem 314 engages the catch 312 and the intermediate part 313*a*. After this, the intermediate part 313*a* and the catch 312 are locked and cannot be turned for a shot. To make a shot, the user has to move the safety stem 314 downwards to the fire position, using for this purpose the knob 326. Now the user can make a shot if he or she pulls the trigger. But if the user reconsiders his or her decision to make a shot, when the safety stem 314 is already in the fire position, the user can move manually the safety stem 314 upwards into the safe position using the knob 326.

Although but a few modifications of the present invention have been illustrated and described, it will be apparent to those skilled in the art that various changes and modifications may be made therein without departing from the spirit of the invention or from the scope of the appended claims.

What is claimed is:

1. In a projectile shooting device: a projectile pusher; trigger means including a trigger and a turnable catch for holding said projectile pusher in a cocked position and for releasing said projectile pusher therefrom; and safety means for preventing unintentional shooting, said safety means including a movable intermediate element movable between fire and safe positions and cooperating with said projectile pusher so that when said projectile pusher moves during cocking said intermediate element is moved under the action of said projectile pusher to the safe position into a turning path of said catch preventing the catch from being turned for a shot and thereby preventing unintentional shooting.

2. The invention as defined in claim 1 wherein said trigger consists of at least two separate parts, one of said two parts being accessible to a user and another of said two parts holding the catch when the crossbow is cocked, said other part of said trigger being under the influence of said one part of said trigger.

3. The invention as defined in claim 2 and further comprising an additional transfering part connecting said two parts of said trigger with one another.

4. The invention as defined in claim 1 wherein said movable intermediate element is spring-biased to fix the same in said fire and safe positions; and further comprising means for spring-biasing said movable intermediate element.

5. The invention as defined in claim 1 and further comprising manual switching means accessible to a user to switch manually said movable intermediate element from said fire to said safe position and vice-versa.

6. The invention as defined in claim 5 wherein said manual switching means include a knob connected to said movable intermediate element and projecting outwardly.

7. The invention as defined in claim 1 wherein said projectile pusher is a crossbow string.

8. In a projectile shooting device: a projectile pusher; trigger means including a trigger and a turnable catch for holding said projectile pusher in a cocked position and for releasing said projectile pusher therefrom; said catch being positioned so as to be turned during cocking of said projectile pusher; and safety means for preventing unintentional shooting, said safety means including a movable intermediate element movable between fire and safe positions and cooperating with said catch so that when said catch turns during cocking, said intermediate element is moved under the action of said catch to the safe position into a turning path of said catch preventing the catch from being turned for a shot and thereby preventing unintentional shooting.

9. The invention as defined in claim 8 wherein said movable intermediate element engages in the safe position said trigger preventing unintentional turning of the latter for a shot.

10. The invention as defined in claim 8 wherein said trigger consists of at least two separate parts, one of said two parts being accessible to a user and another of said two parts holding the catch when the crossbow is cocked, said other part of said trigger being under the influence of said one part of said trigger.

11. The invention as defined in claim 10; and further comprising an additional transferring part connecting said two parts of said trigger with one another.

12. The invention as defined in claim 8 wherein said movable intermediate element is spring-biased to fix the same in said fire and safe positions; and further comprising means for spring-biasing said movable intermediate element.

13. The invention as defined in claim 8 and further comprising manual switching means accessible to a user to switch manually said movable intermediate element from said fire to said safe position and vice-versa.

14. The invention as defined in claim 13 wherein said manual switching means include a knob connected to said movable intermediate element and projecting outwardly.

15. The invention as defined in claim 8 wherein said projectile pusher is a crossbow string.

16. The invention as defined in claim 8 wherein said projectile pusher includes a slide-pusher and a crossbow string connected with said slide-pusher.

17. The invention as defined in claim 8 wherein said movable intermediate element includes at least two movable intermediate members, a first movable intermediate member and a second movable intermediate member, said first movable intermediate member cooperating with said catch so that when said catch turns during cocking, said first movable intermediate member moves under the action of said catch and presses said second movable intermediate member to the safe position into a turning path of said catch preventing the catch from being turned for a shot.

18. The invention as defined in claim 17 wherein said second movable intermediate member is spring-biased to fix said second movable intermediate member in the fire and safe positions; and further comprising means for spring-biasing said second movable intermediate member.

19. The invention as defined in claim 17 and further comprising manual switching means accessible to a user to switch manually said second movable intermediate member from said fire to said safe position and vice-versa.

20. In a projectile shooting device: a projectile pusher; trigger means including a trigger and a turnable catch for holding said projectile pusher in a cocked position and for releasing said projectile pusher therefrom; and safety means for preventing unintentional shooting, said safety means including a movable intermediate element movable between fire and safe positions and cooperating with said catch and said projectile pusher so that when said catch turns during cocking, said intermediate element is moved under the action of said catch in the direction of the safe position until the catch sinks under an upper surface of the shooting device on which the projectile pusher rests when it is in the cocked position, and after this the projectile pusher engages said intermediate element and moves it farther to the safe position into a turning path of said catch preventing the catch from being turned for a shot and thereby preventing unintentional shooting.

* * * * *

UNITED STATES PATENT AND TRADEMARK OFFICE

CERTIFICATE OF CORRECTION

PATENT NO. : 5,596,976
DATED : January 28, 1997
INVENTOR(S) : Shimon Waiser

It is certified that error appears in the above-indentified patent and that said Letters Patent is hereby corrected as shown below:

On title page, item [54], line 3, "SAFELY" should read --SAFETY--.
Column 1, line 3, "SAFELY" should read --SAFETY--.
Column 2, line 62, after "position" period "." should read semi-colon --;--.
Column 3, line 33, "see FIGS. 41-42" should read --(see FIGS. 41-42)--.
Column 3, line 42, "(not shown)" should read --(see FIGS. 41-42)--.
Column 4, line 1, "shod" should read --short--.
Column 5, line 61, "(not shown)" should read --(see FIGS. 41-42)--.
Column 6, line 41, between "cocking" and "said" insert a comma --,--.

Signed and Sealed this
Fifth Day of August, 1997

Bruce Lehman

*Attest:*

BRUCE LEHMAN

*Attesting Officer*

*Commissioner of Patents and Trademarks*